US006927673B2

(12) United States Patent
Right et al.

(10) Patent No.: US 6,927,673 B2
(45) Date of Patent: Aug. 9, 2005

(54) METHOD AND APPARATUS FOR ADJUSTING AUDIBLE AND VISUAL OUTPUTS OF A MOUNTED ALARM DEVICE

(75) Inventors: Robert W. Right, Bradenton Beach, FL (US); Hilario S. Costa, Sarasota, FL (US)

(73) Assignee: Edwards Systems Technology, Inc., Cheshire, CT (US)

( * ) Notice: Subject to any disclaimer, the term of this patent is extended or adjusted under 35 U.S.C. 154(b) by 0 days.

(21) Appl. No.: 10/142,951

(22) Filed: May 13, 2002

(65) Prior Publication Data

US 2003/0210153 A1 Nov. 13, 2003

(51) Int. Cl.[7] ..... G08B 27/00
(52) U.S. Cl. ..... 340/326; 340/331
(58) Field of Search ..... 340/326, 332, 340/331, 384.1, 392–392.3, 321

(56) References Cited

U.S. PATENT DOCUMENTS 3,604,853 A * 9/1971 Pless ..... 381/91
3,948,250 A * 4/1976 Weisman ..... 128/2.06 F
4,074,244 A * 2/1978 Balderson ..... 340/326
4,365,439 A * 12/1982 Litynski ..... 46/227
5,060,506 A * 10/1991 Douglas ..... 73/571
5,570,322 A * 10/1996 Miller ..... 367/107
5,576,690 A * 11/1996 Waugh et al. ..... 340/539.1
6,411,201 B1 * 6/2002 Hur et al. ..... 340/332
6,424,255 B1 * 7/2002 Shanahan ..... 340/457
6,594,614 B2 * 7/2003 Studt et al. ..... 702/150
6,781,517 B2 * 8/2004 Moster et al. ..... 340/825.19

* cited by examiner

*Primary Examiner*—Brent A. Swarthout
(74) *Attorney, Agent, or Firm*—Baker & Hostetler LLP

(57) ABSTRACT

A method and apparatus that includes housing in which a speaker and strobe light are located with the speaker linked to an audio alert adjuster and a strobe light linked to a visual alert adjuster. The alert levels of both the speaker and the strobe are shown on the exterior of the housing for ease of inspection. The adjusters are located within or outside the housing. The adjuster located within the housing aid in preventing tampering with the levels.

28 Claims, 3 Drawing Sheets

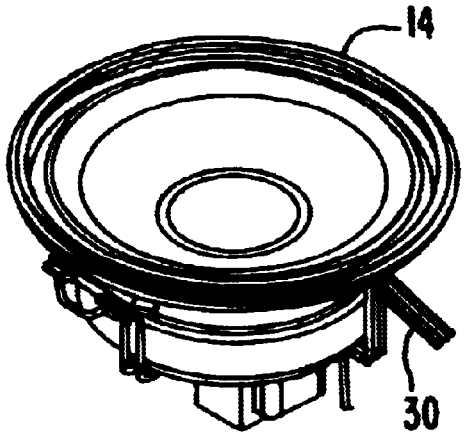
FIG. 2
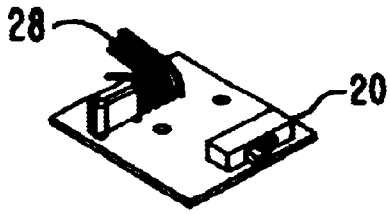

METHOD AND APPARATUS FOR ADJUSTING AUDIBLE AND VISUAL OUTPUTS OF A MOUNTED ALARM DEVICE

FIELD OF THE INVENTION

The present invention relates generally to a device for alerting individuals within an area of the presence of an emergency situation. More particularly, the present invention relates to the combination of a speaker and strobe located within a housing in which the alert levels of both the speaker and strobe are adjustable and the alert level setting is indicated on the exterior of the housing.

BACKGROUND OF THE INVENTION

Fire alarm systems comprise a number of components including such devices as indicators and detectors. The latter consists mainly of fire and smoke detectors. Indicators range from audio devices such as bells and sirens to visual devices such as strobe lights. For instance, the prior art consists of a number of sirens or bells, which are placed in a housing and located strategically throughout a building and linked to the control panel of the alarm system. Upon the detection of an emergency situation, the siren would activate and serve as an indicator of an emergency situation.

More recent advances in alerting technology incorporate the use of a strobe light. The strobe light, like the bell or siren is connected or wired directly to the control system. The strobe light functions to serve as an indicator, like the siren, of an emergency in the area.

The strobe, however, has a different impact than that of the siren. For example, the strobe light is better able to notify those with a hearing disability of the presence of an emergency. Furthermore, the light is effective in nighttime situations especially when the individual is outside the siren's range. This is especially true when the siren or speaker malfunctions and is unable to produce an audible sound. As a result of the mechanical failure possibility, the previous audible alert system is incorporated with a strobe light serving the dual purpose as detailed. In fact, many local towns or municipalities have mandated by law the use of both strobes and sirens to alert individuals as to an emergency.

Mere placement of the devices into a building office is not always sufficient. Different buildings and environments require different needs. For instance, some buildings have a greater capacity to deliver sound or reflect the strobe light based upon the buildings interior make-up. Therefore, a setting in one building or office might not be the correct setting in another office on a different floor or building.

For example, an interior office with ceramic tile flooring and a combination of exposed wood and metal framing has a greater capacity to reflect sound throughout the space. An interior office with wall-to-wall carpeting and tapestry for wall coverings is more susceptible to sound being absorbed or deadened. As a result, the ability of some areas of the office to hear or see the emergency alert is limited.

To combat the differing interior environments, local municipalities have passed ordinances mandating the strength of both the audio and visual alert systems. These ordinances are meant to ensure that these alerting devices, when activated, reach all corners of the office without regard to the sound absorbing materials. Those within a sound-absorbing environment should be able to hear the indicator as well as those in the ceramic floor illustration.

Therefore, there is a need for a fire alarm alert device, which incorporates the use of an audio and visual alert system. In this combined system, there is a need for alert levels to be adjusted independently of one another. There is also a need to provide access to the device without completely removing the device from the structure to which it is affixed. Furthermore, there is a need to provide a visual verification of the alert level setting without having to dismantle the device to determine the current setting.

SUMMARY OF THE INVENTION

The above and other features and advantages are achieved through the use of novel adjustable switches that enable a user at a glance to determine the independent settings for both an audio and visual alert apparatus. The switches are accessible through the use of a removable faceplate, which would overcome the current products on the market that require the removal of the entire device from the fixed structure as herein disclosed.

In accordance with one embodiment of the present invention, a mounted visual and audible alarm device is assembled to warn those within the vicinity of an emergency situation. The device includes an audio alert apparatus located within the device. The audio alert apparatus is linked to an audio alert adjuster, which allows a user to vary the decibel level of the audio alert apparatus. The current setting is available from a visual inspection of the device's exterior face. The device also includes a visual alert apparatus located within the device and a visual alert adjuster linked to the visual alert apparatus. The visual alert adjuster allows the intensity level of the visual alert apparatus to be adjusted. As with the audio adjuster, the visual adjuster setting is visible on the exterior setting of the device.

In another feature of the invention, the device contains a front and rear-face plate. The rear face place, in the preferred embodiment, is fixed to a structure such as a ceiling or a wall. The front-face plate is detachable from the rear-face plate. This allows a user to inspect the inner components of the device without the need to remove the device entirely from the structure.

In an alternate embodiment of the invention, a method for setting the visual and audio level of alarm device includes adjusting the audio and visual alert levels of a speaker and strobe located within a housing to accommodate the differing environments and their impact on the alerting apparatus. The adjustment or setting, as chosen by the user, is indicated on the exterior face of the device. To adjust these levels, a detachable front-face plate is employed to allow ease of access to the adjustable components.

In yet another feature of the alternate embodiment, the step of indicating the audio and visual alert levels includes a window to indicate the current setting. This allows an individual to visually inspect the exterior face of the device to determine the settings. It also permits the authorized personnel to determine whether the setting was tampered or altered without authorization.

In another embodiment of the invention, an apparatus is provided for setting the visual and audio level of alarm device. This device includes a means for adjusting the audio level of a speaker located within a housing, means for indicating the audio level on an exterior of the device, means for adjusting the visual alert level on a strobe located within the housing and a means for indicating the visual alert level on an exterior of the device. A means for accessing the audio and visual alert levels is provided to allow for ease of adjustment. Once the levels are set a means for indicating the audio and visual alert levels is included to allow for quick inspection of the device.

In the preferred embodiment, the audio alert apparatus is a speaker that transmits an emergency signal, which can be but not limited to a siren, bell or a recorded message. The visual alert apparatus is a strobe light. The audio and visual alert levels are adjusted using an electric switch. The switch allows the levels to be adjusted to a predetermined number and level of intensity. The setting for both the audio and visual alert levels are visible by inspecting the exterior of the device.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 2 is an illustration of the interaction of the audio alert apparatus and the corresponding audio alert adjuster.

DETAILED DESCRIPTION OF PREFERRED EMBODIMENTS OF THE INVENTION

A preferred embodiment of the present invention provides an alarm device that alerts individuals in an area of an emergency situation. The device allows the levels of both the audio and visual alert apparatuses to be adjusted to accommodate the interior sound absorbing conditions. The levels are indicated on the exterior face of the device so as to provide an efficient means for inspection. Furthermore, the level adjusters are accessible without removing the entire device from the structure to which it is affixed.

Figure 1:
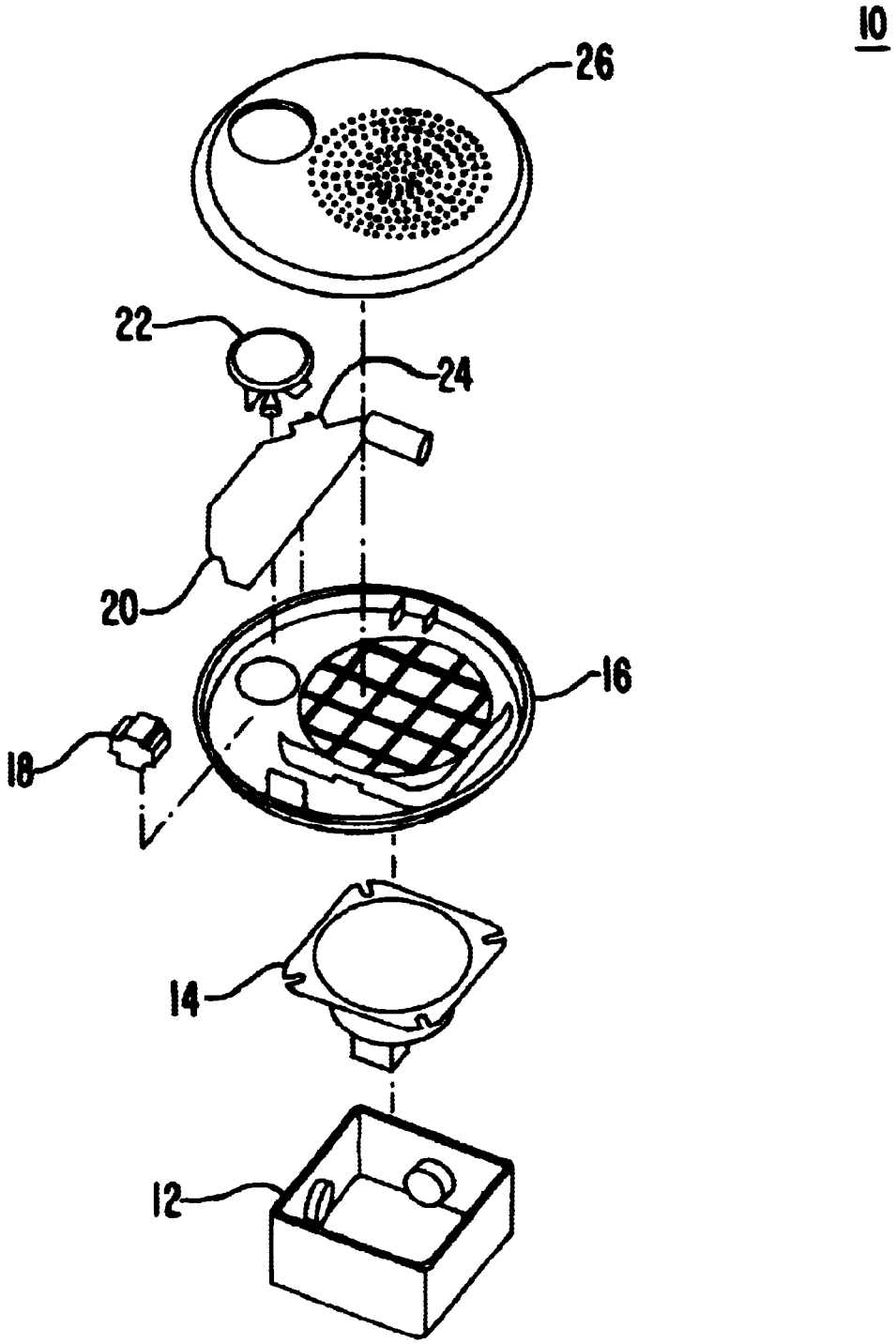
FIG. 1 is a schematic illustrating several elements of a preferred embodiment of the present invention.

A preferred embodiment of the present inventive apparatus is illustrated in FIG. 1. The alarm device 10 is an extension of an alarm control system that warns individuals in an area of the presence or potential of an emergency situation. The alarm device 10 is strategically located within this area to give it the maximum possible effect.

The alarm device 10 is ceiling mounted. In the preferred embodiment, the device is connected to a four-inch junction 12. The junction box 12 provides a central location to where power is provided to the alarm device 10. It also provides a central location to where a wire communication access is completed to the alarm control station or panel.

Within the junction box 12, an audio apparatus 14 is placed. In the preferred embodiment, the audio apparatus 14 is a speaker. The speaker transmits the audio signal to the individuals in the area. For example, the audio apparatus 14 produces a bell or a siren like sound to warn those in the area of an emergency situation. The audio apparatus 14 can also transmit recorded or live warnings as to the presence of an emergency situation. In the instance of a live warning, a central base station operator communicates a message that is broadcast by the speaker 14.

The speaker 14 connects to a rear or back faceplate 16. The rear faceplate 16 connects to the junction box 12, which is pre-hung to a ceiling or wall. The rear-face plate 16 also connects to the ceiling or wall.

Located within the rear-face plate is a line-matching transformer 18. The line-matching transformer 18 matches 75 voltage regulator modules (VRMS) or 25 VMRS line voltage distribution for the audio alert apparatus 14. The transformer 18 drives the eight-ohm impedance of the audio alert apparatus 14. In the preferred embodiment, the transformer is a multitap version so that a user can adjust the audio level.

The audio alert apparatus 14 is linked to an audio alert adjuster 20, which enables the audio alert apparatus 14 to be custom fit into the environment in which it is placed. The preferred embodiment incorporates the uses of an electric switch that adjusts the audio wattage level. In essence, this is known as an audio wattage tap. The user, in the preferred embodiment, can adjust to four different alert levels. They can select from a ¼, ½, 1 and 2-watt setting. The audio setting alters the resistance level of the audio circuit.

The invention is not limited to the audio setting as described herein. The variability of wattage selected ranges can vary based on the needs of the user. The settings, as incorporated in the preferred embodiment, are chosen based on the average range of need for the user of this product.

The audio setting is chosen based upon a predetermined criteria. For example, local municipalities mandate the strength of the alert levels as they pertain to audio and visual alert system. The installer of the device 10 would have to make an assessment of the surroundings and their ability to transmit the sound and light effectively within the surrounded area. For example, a restaurant with ceramic tile floors with a open architecture would be able to choose a lower setting and be able comply with the mandate than that of a restaurant with wall-to-wall carpeting with heavy fabric used throughout the establishment. In this latter instance, to achieve the same sound effectiveness as prescribed by local ordinance, a higher wattage setting is needed. The carpeting and fabrics absorb the sound as opposed to ceramic tiles and open architecture, which reflect the sound throughout the room.

Located within the rear-face plate 16 is a strobe light 22. In the preferred embodiment, the strobe light 22 is an optical assembly that uses constructive occlusion and not specular reflectors. Linked to the strobe light 22 is a visual alert adjuster 24. The visual alert adjuster allows the intensity of the strobe light 22 to be adjusted to the level the environments dictates. Some jurisdictions have a minimum strobe intensity that the visual alert apparatus must be set in order for the device to perform its tasks effectively. As with the audio alert apparatus 14, the conditions of the environment for a large part dictate the proper setting. In the preferred embodiment, the visual alert adjuster 24 includes a four-position setting. The preferred embodiments settings are 15 candela, the minimum, 30 candela, 75 candela and 110 candela, the maximum setting.

The device 10 has a front-face plate 26, which encloses all the components. The front-face plate 26 is easily detachable from the rear-face plate giving access to the components located therein. In the preferred embodiment, the ease of removal of the front-face plate 10 enables an individual to determine the current setting for both the audio and visual alert adjusters 20, 24. Previous systems required the individual to remove the entire device 10 from the attached structure and then access the settings therein. This invention overcomes this limitation by using a detachable face plate that grants access to the internal components which includes adjustability of the alert apparatuses 14, 22.

In an alternate embodiment, the setting of the alert adjusters 20, 24 is visible through a window on the exterior face of the device 10. Therefore, a visual inspection of the device 10 and its corresponding settings is determined without any dismantling of the device 10 and even without the need to remove any faceplates. In this alternate embodiment, a dial-type adjuster is employed and adjustable from the exterior of the device. By turning the dial-type adjuster, the inspection window is updated to the alert setting selected.

FIG. 2 is an illustration of the interaction between the audio alert apparatus 14 and the corresponding audio alert adjuster 20. In this example, the audio alert adjuster 20 is connected to the audio apparatus via wire 28, 30. The audio alert adjuster 20 provides the use of an electric switch that enables the user to select the audio decibels desired. The preferred embodiment uses the switch because of its low-cost effective design. However, the invention is not limited to the use of a switch. Also contemplated by this design is remote adjustability of the alert levels. For example, the invention is designed to include the use of a receiver and transmitter for non-wire remote adjustability. One such remote adjustability technology is infrared (IR). The user with the aid of a remote tool transmits to an IR port on the device 10 the desired remote setting. As with the preferred embodiment, the alert setting is visible from the exterior. In this instance, a digital display is used to indicate the selected setting. Other such remote technologies contemplated by this invention include long and short-range radio frequency such as BLUE-TOOTHS™.

Figure 3:
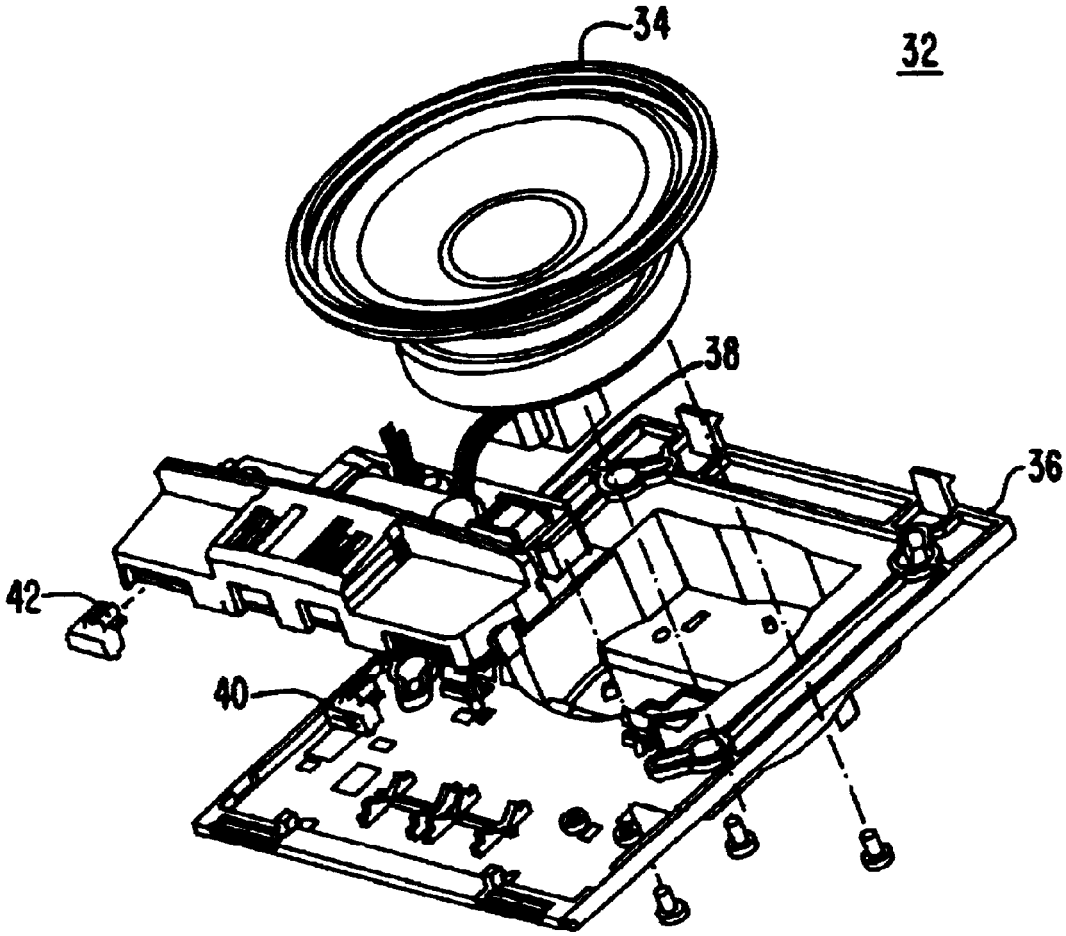
FIG. 3 is an illustration of an alternate embodiment of the present invention.

FIG. 3 is an illustration of an alternate embodiment of the present invention. The alternate embodiment is a wall alarm device 32. One of the significant differences is that the device is rectangular in shape as opposed to the circular shape of the ceiling mounted device 10. The wall alarm device 32 includes an audio alert apparatus 34, which is secured to a rear-face plate 36. In this alternate embodiment, the audio alert apparatus can be a speaker or its equivalent. The speaker is linked or connected to an audio alert adjuster 40, which is an electric switch with a multitude of audio level settings.

The wall-mounted device 32 also includes a visual alert device 38 and its corresponding visual alert adjuster 42. The visual alert device 38 is a strobe light that is adjustable in intensity with the visual alert adjuster 42.

Unlike the ceiling mounted device 10, the adjuster 40, 42 does not require the user to remove any faceplate to adjust the intensity levels. In this alternate embodiment, the adjusters 40, 42 are modifiable from the exterior face of the wall-mounted device 32.

The intensity level on the alert apparatuses are visible from the exterior face of the mounted ceiling device 32. A visual inspection can indicate if the proper setting is selected, as well, as if the setting was tampered with after the initial setting was made.

The many features and advantages of the invention are apparent from the detailed specification, and thus, it is intended by the appended claims to cover all such features and advantages of the invention, which fall within the true spirits, and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A mountable visual and audible alarm device to warn those within the vicinity of an emergency situation, comprising:

an audio alert;

an audio alert adjuster, linked to the audio alert, that varies the audio output of the audio alert, wherein the audio alert adjuster is accessible without dismantling this device;

a visual alert located within the device;

a visual alert adjuster, linked to the visual alert, that varies the intensity levels of the visual alert, wherein the visual alert adjuster is accessible without dismantling this device; and a window located on the exterior of the device, the window is configured to indicate a current setting for the audio alert and the visual alert simultaneously audio and visual levels can be ascertained by viewing the device.

2. The device of claim 1, wherein the device is comprised of a front faceplate and a rear faceplate.

3. The device of claim 2, wherein the rear face plate is fixed to a structure.

4. The device of claim 3, wherein the front face plate is detachable from the rear faceplate.

5. The device of claim 1, wherein in the audio alert is a speaker.

6. The device of claim 1, wherein the audio adjuster is an electric switch.

7. The device of claim 1, wherein the visual adjuster is an electric switch.

8. The device of claim 6, wherein the electric switch indicates the audio alert setting.

9. The device of claim 1, wherein the audio alert adjuster is varied with a remote control.

10. The device of claim 9, wherein the remote control alters the audio alert adjuster with infrared signals.

11. The device of claim 9, wherein the remote control alters the audio alert adjuster with radio frequency signals.

12. The device of claim 7, wherein the electric switch indicates the visual alert setting.

13. The device of claim 1, wherein the visual alert device is a strobe device.

14. The device of claim 1, wherein the audio and visual alert adjusters are located within the housing accessed by detaching the front faceplate.

15. A mountable visual and audible alarm device to warn those within the vicinity of an emergency situation, comprising:

a housing comprising a speaker and a strobe light;

an audio adjuster linked to the speaker that adjusts the audio level of the speaker, wherein the audio level is adjusted without dismantling the device;

a strobe adjuster linked to the strobe light adjusts the intensity level of the strobe light, wherein the intensity level is adjusted without dismantling the device; and a window that is configured to indicate a current setting of the audio level and intensity level simultaneously in order that the audio and intensity levels can be ascertained by viewing the device.

16. A method for setting the visual and audio level of mountable alarm device, comprising:

adjusting the audio level of a speaker located within a housing from the exterior of the device;

indicating the audio level on an exterior of the device through a window;

adjusting the visual alert level on a strobe located within said housing from the exterior of the device; and indicating the visual alert level on an exterior of the device through a window the audio and visual alert levels visible simultaneously in order that the audio and visual levels can be ascertained by viewing the device.

17. The method of claim 16, further comprising accessing the audio and visual alert levels through a detachable front faceplate of the housing.

18. The method of claim 16, wherein the steps of indicating the audio and visual alert levels comprises a window to indicate the current setting.

19. The method of claim 16, wherein an electric slide switch adjusts the audio alert level.

20. The method of claim 16, wherein an electric slide switch adjusts the visual alert level.

21. An apparatus for setting the visual and audio level of an alarm device, comprising:

means for adjusting the audio level of a speaker from an exterior of the device;

means for indicating the audio level on an exterior of the device in order that the audio level can be ascertained without dismantling the device;

means for adjusting the visual alert level on a strobe located from the exterior of the device; and means for indicating the visual alert level on the exterior of the device in order that the visual level can be ascertained without dismantling the device the audio and visual levels being indicated simultaneously.

22. The apparatus of claim 21, further comprising a means for accessing the audio and visual alert levels located within the housing.

23. The apparatus of claim 21, wherein the means for indicating the audio and visual alert levels is a digital display.

24. The apparatus of claim 21, wherein the means for adjusting the audio and visual alter levels is an electric slide switch.

25. A mountable visual and audible alarm device to warn those within the vicinity of an emergency situation, comprising:

an audio alert located on an exterior of the device;

a visual alert located within the device;

an alert adjuster, linked to the audio and video alerts, located on the exterior of the device; and a window that indicates a setting level of the audio and visual alerts on the exterior of the device simultaneously in order that the audio and visual setting levels can be ascertained by viewing the device.

26. The device of claim 25, wherein the alert adjuster is comprised of a an audio alert adjuster linked to the audio apparatus that varies the audio output of the audio alert apparatus and a visual alert adjuster linked to the visual alert apparatus that varies the intensity levels of the visual alert apparatus.

27. The apparatus as in claim 1, wherein the alert is the audio alert.

28. The apparatus as in claim 1, wherein the alert is the visual alert.

* * * * *